US009482232B2

(12) United States Patent
Andersen

(10) Patent No.: US 9,482,232 B2
(45) Date of Patent: Nov. 1, 2016

(54) SUBMERSIBLE ELECTRICAL WELL PUMP HAVING NONCONCENTRIC HOUSINGS

(71) Applicant: Norali AS, Mathopen (NO)

(72) Inventor: Gunnar Andersen, Mathopen (NO)

(73) Assignee: Norali AS, Mathopen (NO)

( * ) Notice: Subject to any disclaimer, the term of this patent is extended or adjusted under 35 U.S.C. 154(b) by 432 days.

(21) Appl. No.: 13/795,098

(22) Filed: Mar. 12, 2013

(65) Prior Publication Data

US 2013/0236341 A1 Sep. 12, 2013

(30) Foreign Application Priority Data

Mar. 12, 2012 (NO) ..... 20120289

(51) Int. Cl.

| | |
|---|---|
| ***F04D 13/08*** | (2006.01) |
| ***F04D 29/42*** | (2006.01) |
| ***F04D 1/06*** | (2006.01) |
| ***F04B 47/06*** | (2006.01) |
| ***F01D 25/24*** | (2006.01) |
| ***F04D 13/10*** | (2006.01) |
| ***F04D 29/62*** | (2006.01) |
| ***F04D 13/12*** | (2006.01) |

(52) U.S. Cl.

CPC ..... *F04D 13/086* (2013.01); *F01D 25/24* (2013.01); *F04B 47/06* (2013.01); *F04D 1/063* (2013.01); *F04D 13/10* (2013.01); *F04D 13/12* (2013.01); *F04D 29/426* (2013.01); *F04D 29/628* (2013.01)

(58) Field of Classification Search

CPC ..... F04D 1/06; F04D 1/063; F04D 13/02; F04D 13/06; F04D 13/0646; F04D 13/08; F04D 13/086; F04D 13/12; F04D 13/14; F04D 13/10; F04D 29/628; F04D 29/605; F04D 29/62; F04D 29/42; F04D 29/426; F04D 29/328; F04B 47/06; F01D 25/26

See application file for complete search history.

(56) References Cited

U.S. PATENT DOCUMENTS

| | | | | |
|---|---|---|---|---|
| 1,740,003 | A | 12/1929 | Coberly | |
| 2,514,865 | A * | 7/1950 | Hornschuch | 415/108 |
| 2,667,128 | A * | 1/1954 | Bergh | F04D 1/063 415/110 |
| 3,112,049 | A * | 11/1963 | Messer | 222/333 |
| 4,278,399 | A | 7/1981 | Erickson | |
| 4,749,034 | A * | 6/1988 | Vandevier | E21B 43/128 166/105 |
| 5,179,306 | A | 1/1993 | Nasar | |
| 5,201,848 | A | 4/1993 | Powers | |
| 6,811,382 | B2 * | 11/2004 | Buchanan | E21B 43/128 415/199.1 |
| 8,079,418 | B2 * | 12/2011 | Brown | E21B 43/128 166/105 |
| 2002/0066568 | A1 | 6/2002 | Buchanan et al. | |
| 2006/0243450 | A1 * | 11/2006 | Head | E21B 17/026 166/369 |
| 2009/0068037 | A1 * | 3/2009 | Shaw et al. | 417/423.3 |

FOREIGN PATENT DOCUMENTS

NO 20100871 A1 12/2011

* cited by examiner

*Primary Examiner* — Charles Freay
*Assistant Examiner* — Timothy P Solak
(74) *Attorney, Agent, or Firm* — Osha Liang LLP

(57) ABSTRACT

A pump includes at least one pump section. The pump section has a center line and comprises at least two pump steps. The pump steps have a center line and each pump step comprising a motor and one or more pump stages. The at least one pump section includes an outer casing enclosing one or more inner casings. The outer casing forms an enclosure round the pump section and has a larger diameter than the inner casings. The inner casings form an enclosure round the at least two pump steps. The center line of the pump section is displaced relative to the center line of the pump steps, thereby forming an annulus between the outer casing and the inner casing.

14 Claims, 12 Drawing Sheets

SUBMERSIBLE ELECTRICAL WELL PUMP HAVING NONCONCENTRIC HOUSINGS

CROSS-REFERENCE TO RELATED APPLICATIONS

This application claims priority to Norwegian Patent Application No. 20120289, filed on Mar. 12, 2012, and entitled "PUMP HAVING A PRESSURE COMPENSATED ANNULAR VOLUME." This priority application is incorporated herein by reference in its entirety.

SCOPE OF THE PRESENT DISCLOSURE

The present disclosure relates to a pump which is divided into separate sections, pump steps and pump stages. The pump may be installed down in wells in order to pump hydrocarbons and water to the surface.

BACKGROUND OF THE PRESENT DISCLOSURE

Centrifugal pumps are previously known for use down in oil-producing wells. These pumps employ a so-called multistage principle, where the pump consists of several vertically-arranged stages. A stage comprises substantially of an impeller and a diffuser. All the impellers are attached to a common shaft which passes through all the pump stages, and all of these stages are located inside one and the same casing. The shaft passing through all the pump stages is driven by an electric motor which is mounted on the underside (below in the longitudinal direction) of the actual casing. An example of this technology is the ESP or Electrical Submersible Pump which exists on the market today. The reason for using several pump stages is that each individual pump stage in itself has limited ability to deliver pressure increase. In order to achieve sufficient pressure, pumps of this type have to use several pump stages which are hydraulically connected in series and mounted on top of one another in the longitudinal direction.

However, there are disadvantages with the technical design of existing multistage pumps, such as, for example, that all the pump stages are driven by one motor via a common shaft, with the result that the whole pump stops if the motor stops. In addition, the existing constructions become very long due to the fact that the motor is mounted below the pump stages in the longitudinal direction. This is a problem when the pump is employed in wells where the well path is deviated relative to the vertical. In addition the bearings in today's pumps suffer from a short working life on account of severe loads and wear on impellers due to cavitation.

Production of hydrocarbons, and/or water for use in recovery of hydrocarbons and for other purposes, is carried out from reservoirs located down in rocks below the earth's surface. The vertical distance from the surface down to these reservoirs may vary from a few hundred meters down to several thousand meters.

The actual production is conducted either by means of artificial lift or by reservoir fluids, which may contain loose or free gas, flowing to the surface through a borehole/well because the pressure in the reservoir is higher than the pressure on the surface. Artificial lift is a common term for different methods and techniques which may be employed for this production. This present disclosure comprises equipment for improving artificial lift of hydrocarbons (with or without gas) and/or water to the surface. The choice of method for artificial lift is made on the basis of conditions in the reservoirs, the nature of the oil, the depth and well path of the borehole/well. In addition, importance is attached to the field's location (on shore or at sea) and the area's infrastructure, such as access to electric power and gas at the actual location. Based on these parameters, by means of the present disclosure the field operator can construct an installation which offers the best possible total economy based on the reservoir's production characteristics, investment in equipment and operating costs.

On shore fields with relatively shallow reservoirs and with reasonably vertical well paths, a system called a sucker rod pump is often chosen. In this case the actual drive gear is located on the surface, coupled to a pump unit down in the well via a pump rod. With this system the challenges are a relatively large drive gear which is located above and near the wellhead, friction between pump rod and pipe wall in the well, production of sand from the reservoir and a system efficiency of 0.4. There are also restrictions as to how deep this type of pump system can be located based on material/strength limitations on the pump rod. The systems have limited lifting capacity, and are therefore employed at lower production rates. The system's design per se, together with operating conditions such as sand production, leads to regular operational stoppages. In addition to increasing the direct operating costs, this leads to costs in connection with production delays. The length of stroke on the actual pump unit in a sucker rod pump is from two to three meters, and the frequency is from one to ten strokes per minute. In U.S. Pat. No. 5,179,306, a principle is described where the pump unit in a sucker rod pump is driven by a double-acting DC linear motor placed down in the well together with the pump unit in order thereby to avoid the challenges associated with the actual pump rod.

ESPCP and PCP are also systems which are used for artificial lift. In principle these are two identical pumps which differ in that ESPCP (Electrical Submersible Progressive Cavity Pump) is driven by an electric motor located down in the well, while PCP (Progressive Cavity Pump) is driven by a motor located on the surface. The power to a PCP is transferred from the surface to the pump down in the well via a pump rod, in the same way as for a sucker rod pump. The pumping principle employed in these pumps is often described as a screw pump where a rotor moves in a circular manner inside a specially-designed pump housing. ESPCP may be employed on installations both at sea and on shore, while PCP is only used on installations on shore. This type of pump is considered to be well-suited to production of heavy viscous oils, and generally considered to have an efficiency which is better than ESP which is described in the next paragraph.

An Electrical Submersible Pump (ESP) is a pump type which is widely used for artificial lift both at sea and on shore installations. The pump is mounted down towards the bottom of the well as an integrated part of the production tubing. This means that if the pump fails, the whole tubing has to be pulled out of the well. The actual pump consists substantially of an electric motor located in the bottom, from which there extends a shaft and on this shaft are mounted a plurality of impellers which are mounted in pairs with an associated diffuser, each such pair being called a pump stage. The number of pump stages mounted on the shaft from the electric motor is determined on the basis of the need for necessary lifting height (pressure), and large pumps may have more than 250-300 pump stages. The liquid is sucked into the bottom of the pump and with each pump stage the pressure is increased. In order to reduce the number of pump stages, the rotational speed can be increased, thereby providing a reduction in the total length of the pump. In U.S. Pat. No. 4,278,399, a solution is described for a more efficient pump stage in an ESP.

The efficiency factor of such ESP pumps is considered to be 0.3 and the volume flow can vary from a few hundred barrels per day to 20-30,000 barrels (1 barrel=158.97 liters) per day. The electric motor in the pump has power supplied from the surface through a special cable which is attached to the outside of the production tubing and the pump casing before being connected to the electric motor located in the bottom of the pump. The pump is controlled from the surface by means of a system called Variable Speed Drive (VSD). VSD transforms alternating current (AC) to direct current (DC) and back to an alternating current (AC) where the frequency can be manipulated. This manipulation of the frequency is used to alter the rotational speed of the pump. This creates wear on electric cables and connectors and may also lead to earthing problems.

Normally it is electric motors of the induction motor type which drive the actual pump, and on account of the need for a great deal of power in the case of high rates and deep wells, these motors become relatively long. In these motors there is little clearance between stator and rotor, with the result that small curvatures (deviations) in the well path can create contact between rotor and stator, leading to breakage. The same may occur due to vibrations in the motor in the case long motors of this kind of up to 20 m. On account of this situation, the industry has developed Permanent Magnet motors (PM motors) which have a more robust design. The mechanical challenges associated with ESP are wear and overheating of the electric motor, which PM motors are believed to be better able to tackle.

Substantial axial forces are also developed in the actual ESP pump. There are various solutions which are employed in order to improve this situation, one example of which is U.S. Pat. No. 5,201,848. This patent describes an impeller which does not assist in lifting fluid, but creates a static pressure which provides an upwardly directed force on the shaft. This is accomplished by the main impeller, which contributes to lift, being mounted on top of (in the longitudinal direction) a second impeller of the same volume, where the latter impeller has no circulation of well fluid.

Apart from the said mechanical problems, ESP systems have problems with handling the production of large amounts of sand and other solid particles such as scale. In addition cavitation occurs when free gas is produced from the reservoir. Both of these factors cause wear on the impellers. These factors can be counteracted by manipulating the rotational speed of the motor and thereby also the rotational speed of the impellers. Free gas is also a problem for the actual electric motor since the gas has less ability than liquids to transport the heat generated by the electric motor. All of these factors result in an estimated average life for an ESP system of around 1.5 years, but there are examples of these failing after only a few weeks in operation. The costs of replacing an ESP will vary with the depth of the well, due to the fact that the whole production tubing has to be pulled out. In addition to the direct costs of the operation, which involve the use of a drilling rig, the costs of production delays are also incurred.

One of the major weaknesses of today's ESP pumps is that all parts of the pump are integrated. As mentioned earlier, the shaft extends from the motor, continues through the entire length of the pump, and all the impellers are mechanically connected to this shaft. This means that if a breakage occurs on one or more of the components in the pump, the whole pump stops.

In Norwegian Patent Application No. 20100871 and in US Patent Publication No. US2002/0066568 A1 now U.S. Pat. No. 6,811,382, solutions are described where the pump is composed of steps consisting of motor, impeller and diffuser.

Gas lift is widely used as artificial lift on installations at sea where there is access to produced gas from the separator unit located on the installation. The principle is based on re-injecting produced gas into the annulus, or more specifically the production annulus, between the production tubing and the casing and down towards the production packer in the bottom of the well. Gas lift valves are placed at different levels in the tubing. These are one-way valves which permit the gas in the annulus to flow into the tubing, thereby reducing the pressure of the hydrostatic column inside the tubing. This occurs because the gas has a lower density than the fluids inside the tubing, thereby causing the hydrostatic counter-pressure on the reservoir to also be reduced, with the result that, by means of the injected gas, the reservoir pressure itself can force the produced fluids to the surface. In principle gas lift is an efficient system, but it requires investment in separate gas compressors, surface flow lines, Annulus Safety Valves (ASV), gas lift valves (GLV) and gas-tight pipe threads in the casing. The system can be difficult to operate in an optimal manner since the rate of mixture between oil, water and any gas produced from the reservoir will vary with shorter or longer intervals of time. In addition there is the problem that re-injected gas in the production annulus may leak out into the outer annuli through the casings. In order to reduce the risk of uncontrolled discharge of gas in the event of a system failure, several oil companies now want to develop an ISO V0 version of the gas lift valves so that they can remove ASV, since it has been shown that these ASV's are subject to leakages. This change will help to increase the investment costs for the gas lift system.

Single-acting and double-acting piston pumps are previously known for use in artificial lift. Apart from different designs of the actual pump housing (the pistons) and inlet and outlet valves, there are several different driving mechanisms for the pumps. Everything from electromagnetic motor solutions to solutions with linear motors is involved. In addition a single-acting piston pump is known which is driven by an induction motor which in turn drives a hydraulic unit which in the next phase drives the piston and valves in the pump. This kind of solution is often designed for operation of more than one single-acting piston in the pump. The common feature of all the pumps is that they are intended to be installed down in the bottom of the well. In U.S. Pat. No. 1,740,003 an electrically operated double-acting piston pump is disclosed. In order to reverse the piston movement, the phase of the motor is changed so that it rotates in the opposite direction. With a frequency of between 30 and 60 strokes per minute, there is substantial wear on the contacts which have to reverse the electrical current, and considerable heat generation every time the piston has to change direction. So far no one has managed to make linear motors which are practical and commercial, because, amongst other things, there is a huge increase in power consumption every time the motor has to change direction.

SUMMARY OF THE PRESENT DISCLOSURE

The pump according to the present disclosure comprises at least one pump section, where the pump section has a centre line and where the pump section comprises at least one pump step, the pump step has a centre line and each pump step comprises a motor and one or more pump stages, and where the pump comprises an outer casing enclosing one or more inner casings, where the outer casing forms an enclosure round the pump section and has a larger diameter than the inner casings, and the inner casings form an enclosure round the at least one pump step, and where the centre line of the pump section is displaced relative to the centre line of the pump steps, thereby forming an asymmetrical annulus between the outer casing and the inner casing. The pump may be employed as a permanent, long-term solution in a producing well, or for temporary operations over shorter periods such as in different types of well intervention etc. According to an aspect of the present disclosure the pump comprises several pump sections in order for the device to achieve sufficient lifting capacity to perform the pumping operation in the well concerned. A pump step is defined as comprising at least one pump stage and a motor which drives one or more pump stages in the pump step. A pump stage per se comprises an impeller and an associated diffuser.

Each individual pump step in the pump is located inside an inner casing, where the pump steps have a centre line/centre axis. Between each pump step fluid-tight couplings are arranged so that the inner casings are fluid-tight. The fluid-tight couplings may, for example, be in the form of an O-ring and screws, metal-metal seal and screws, O-ring and threaded coupling, clamps, all possibly in combination with compression resulting from locking rings in the top and bottom of the pump section.

In some embodiments the inner casing may consist of one, two or more parts based on design factors such as which motor design is employed, the number of pump stages in the pump step and the design of the actual impeller/impellers. The inner casings with the pump steps are all located inside an outer casing which forms the enclosure of a pump section. The centre line of the pump steps is displaced in the radial direction, i.e. asymmetrically, relative to a centre line/centre axis of the pump section, thereby forming an asymmetrical annular volume between the inner casings and the outer casing in a pump section. This annular volume, which in an embodiment can be filled with a fluid of the dielectric oil type, is used for housing necessary electrical conductors, signal cables, electrical connectors, electronics, meters and pressure-tight couplings. Since all the electrical conductors and signal cables are located in the asymmetrical annulus, it may be advantageous to employ pressure-tight couplings to feed power and signal cables to motors and any sensors located in towards the centre of the pump step without creating hydraulic communication between the annular volume and the centre of the pump step where the well fluids are located.

This asymmetrical annular volume is in pressure communication with the well in which the pump is located, but the annular volume is closed by a pressure-compensating barrier which prevents the well fluid from penetrating into the asymmetrical annular volume, thereby making contact with the components which are housed in this annular volume. This helps to protect these components from wear and pollution, thereby giving them an increased service life.

The pump according to the present disclosure overcomes the drawbacks associated with the fact that only one electric motor has to drive all the pump stages since the pump according to the present disclosure can employ a motor in each pump step. In addition to being able to drive a pump stage, in another embodiment the motor can also drive two or more pump stages in the pump step via a common shaft. According to the present disclosure the pump is equipped with motors located in towards the centre of the inner casings in the pump steps, i.e. the motors are located where the well fluids are flowing. In one embodiment these motors may be in the form of ring motors, while in another embodiment the pump may be equipped with axial motors. Regardless of which type of motor is chosen in the individual embodiment, both types of motor can drive one or more pump stages in order to achieve sufficient lifting capacity. If ring motors are used, the well fluids will flow in the centre of the ring motors. If axial motors are used, the well fluids will flow on the outside of the motors, but still internally in the inner casings.

The pump has an inbuilt spare capacity. This is because each pump section is composed of separate pump steps, all of which are driven by their own motor. This means that if the motor in one pump step stops, all the other pump steps in the pump section and possibly in the other pump sections will be able to continue to push the well fluids up to the surface. In this connection it is important to have an asymmetrical volume between the inner casings and the outer casing in each pump section to permit all the necessary electrical connectors, electronics, meters and pressure-tight couplings to be housed in a controlled environment. If a pump in an embodiment is equipped with too many pump stages in a pump step which happens to stop, the friction loss in this pump step will be so great (the well fluids have to flow through many impellers which are stationary) that the pump does not manage to deliver an acceptable volume flow even though all the other pump steps are intact, and there will therefore be a natural limit to how many pump stages there can be in a pump step based on the conditions in the well.

The motors in the pump steps may be permanent magnet motors, whether ring motors or axial motors are employed. Alternatively, the motors may be electric induction motors. A permanent magnet motor in itself is extremely effective with a high efficiency factor. Since the motors are no longer provided as a long unit, but are divided between different pump steps, the pump can handle well deviation much better than existing pumps.

Since the pump may have an asymmetrical annular volume which is used for housing necessary electrical connectors, electronics, meters and pressure-tight couplings, it can be equipped with an electrical system which is designed so that each motor, and therefore each pump step, can be run at an individual rotational speed, thus enabling cavitation to be avoided while at the same time the wear resulting from any sand production can be reduced.

Servicing the pump will be easier since the pump steps are not interconnected via a common shaft.

In an embodiment axial bearings and radial bearings may be used to absorb the forces generated by the rotation of the motors. According to an embodiment the pump is characterised by the use of magnetic bearings in order to absorb the forces in the pump. These may be active magnetic bearings or passive magnetic bearings. In another embodiment mechanical bearings are employed, or a combination of magnetic bearings and mechanical bearings.

The pump steps in the pump are located internally in an outer casing. The outer casing has a given length which is determined by the number of pump steps and practical manufacturing considerations together with the space available on the surface. Such a length is called a pump section. Dividing the pump into pump sections will also have its advantages during the operation of installing the pump in a well. In order to achieve sufficient lifting capacity and volume flow, as already mentioned several pump sections may be located one after the other in the longitudinal direction in a well and be interconnected by means of wet connectors, which ensure that the pump sections are in electrical contact and in communication with one another. A wet connector is a standardised principle for connecting/joining electrical conductors and/or signal cables in a volume filled with fluid. The connectors are often used in connection with wells which are either completed or in the process of drilling, and they are used to connect one or more electric cables to a motor or machine which requires electric power or signal transmission. These electrical contacts will be employed for power and signal transmission between the pump sections, thereby enabling all the pump steps and pump sections to be controlled from the surface by means of a control unit for variable speed (VSD), and also data from sensors in the pump to be monitored from a control unit on the surface. Thus it is possible, as for other ESP pumps, to optimise the operation of the pump on the basis of pressure conditions in the well and the composition of the fluids which have to be lifted to the surface.

In an embodiment the motors in the pump steps may be electrically connected so that they can be operated independently of one another, with the same or a different number of revolutions per minute, and with the same or a different direction of rotation.

The fact that the pump is divided into pump sections permits it to be installed in a well by means of cable operations, even though the pump is intended to be employed for permanent artificial lift, indicating that in most cases there will be a need for several pump sections in order to achieve sufficient pressure and production rate. This embodiment is not possible with today's ESP systems. In an embodiment the pump may be installed in the well by means of pipes. The fact that the installation can be undertaken by using industrial standard cable operations, coiled tubing, pressure pipes or drill pipes entails a substantial reduction in the installation costs compared to today's pumps which have to be installed as an integrated part of the production tubing. In addition, this reduces the costs of pulling the pump out again in the event of operational problems. Since the pump can be handled by cable in a wireline operation, it can also be employed during well interventions where wells need to have help to start production. During such temporary installations the pump will be pulled out of the well as soon as the well flows naturally due to the overpressure in the reservoir. This will be a far cheaper method than the present day method of injecting gas into the well by means of coiled tubing in order to start up the well.

In an embodiment of the pump the inner casings comprise at least one distance piece on their radial outside in order to permit the centre line of the pump steps to be displaced relative to the centre line of the pump section. The distance pieces may comprise lead-through holes for cables, wires, lines etc.

The present disclosure also relates to a pump section with a centre line in the axial longitudinal direction, where the pump section comprises at least one pump step, the pump step has a centre line and each pump step comprises a motor and one or more pump stages, and where the pump section comprises an outer casing enclosing one or more inner casings, the outer casing forms an enclosure round the pump section and has a larger diameter than the inner casings, and the inner casings form an enclosure round the at least one pump step, and where the centre line of the pump section is displaced relative to the centre line of the pump steps, thereby forming an annulus between the outer casing and the inner casing.

The objects of the present disclosure are achieved by means of the independent claims, while further features of the present disclosure are specified in the dependent claims.

BRIEF DESCRIPTION OF THE DRAWINGS

The pump according to the present disclosure is described with reference to non-limiting drawings, in which.

DETAILED DESCRIPTION OF THE PRESENT DISCLOSURE

Figure 1:
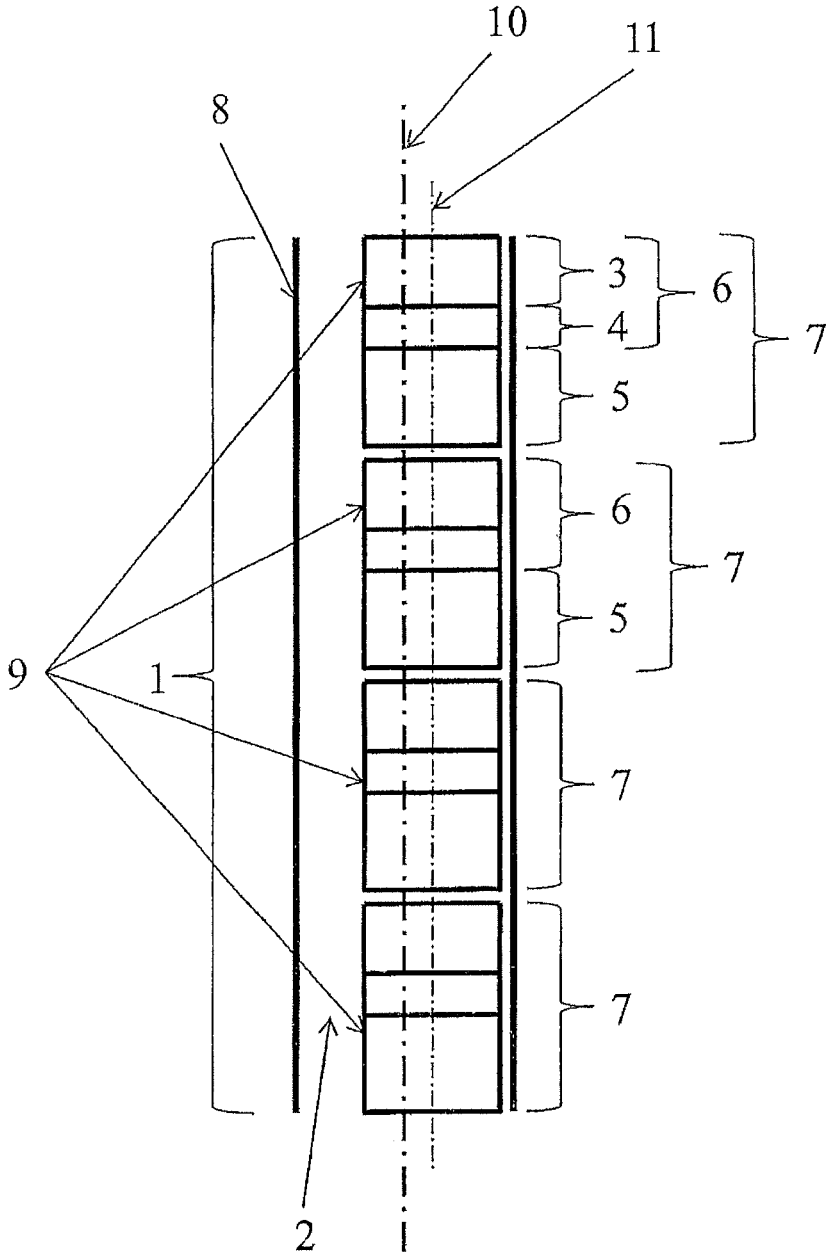
FIG. 1 is a principle drawing of a cut through a pump section with associated pump step and pump stage.

FIG. 1 illustrates a principle drawing of a pump section 1 where the pump steps 7 with inner casings 9 and a centre line 11 are located radially displaced, asymmetrical relative to a centre line 10 of the pump section 1. An annular volume 2 is thereby formed between the outer casing 8 in the pump section 1 and the inner casings 9 in the pump steps 7. The asymmetry is illustrated by the centre line 10 of the pump section 1 being displaced to the left of the common centre line 11 of the pump steps 7. FIG. 1 also shows that the four pump steps 7 each consist of a motor 5 and pump stage 6. It can also be seen in the figure that it is precisely in this embodiment illustrated here that each pump step 7 only has one pump stage 6. A pump stage 6 consists of an impeller 4 and a diffuser 3. The well fluid which has to be lifted to the surface will flow internally in each pump step 7.

Figure 2:
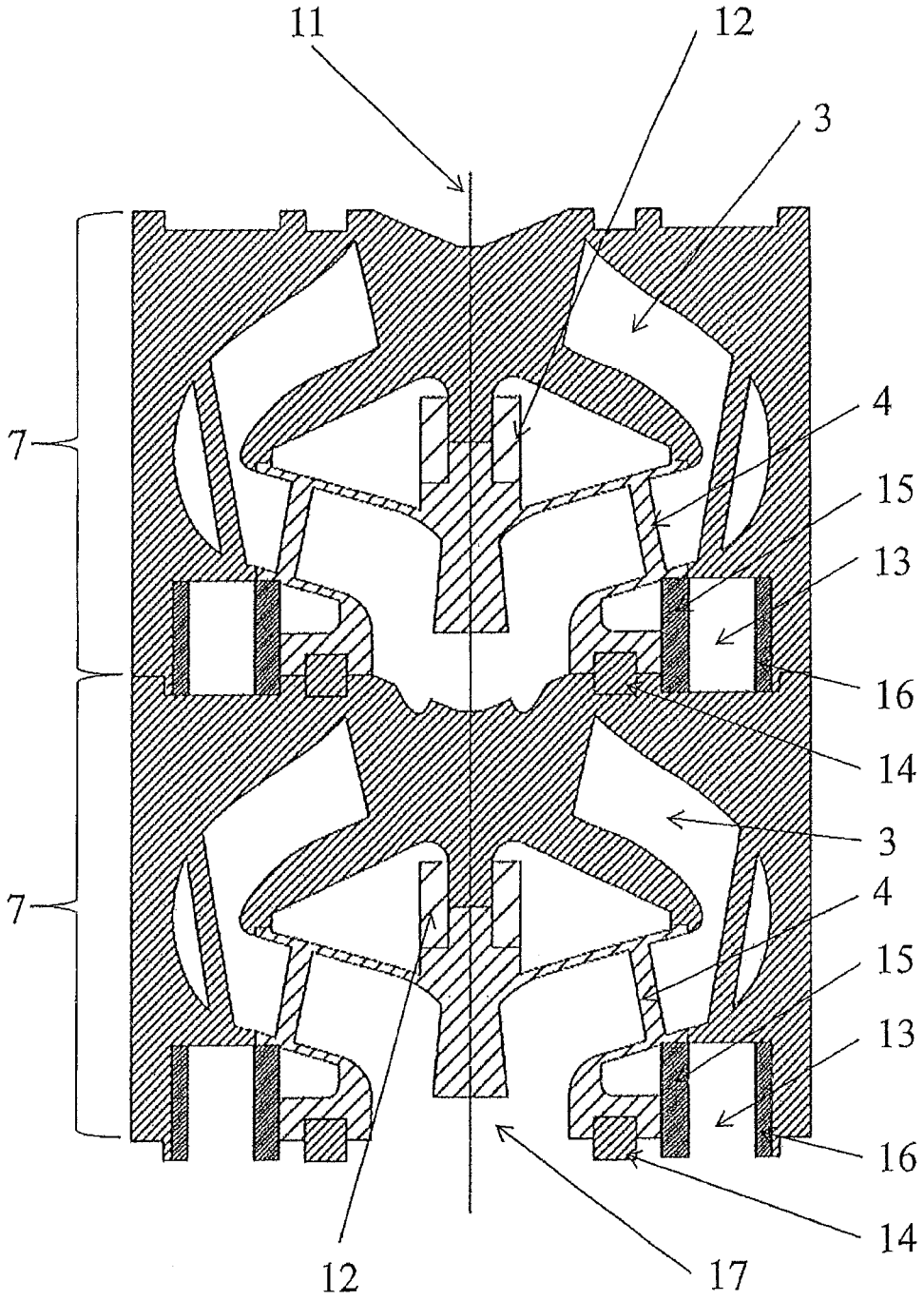
FIG. 2 is a sectional view of two pump steps driven by ring motors.

FIG. 2 illustrates an embodiment of two pump steps 7, both of which in this embodiment contain a pump stage consisting of an impeller 4 and a diffuser 3. In this embodiment the impeller 4 is driven by a ring motor 13 consisting of a stator 16 and a rotor 15. In an embodiment of a pump step 7 the impeller 4 may be an integrated part of the rotor 15 when a ring motor 13 is employed to drive the pump step 7. When the pump step 7 is set in operation with a rotating motion in order to lift the well fluid up to the surface, the rotor 15 and the impeller 4 will rotate at the same speed. The axial forces then generated in the pump step 7 are absorbed by an axial bearing 14, while the centripetal forces created are absorbed by a radial bearing 12. When the pump steps 7 are in operation, the well fluid from the underlying pump step 7 in the pump section in this embodiment is admitted into the internal cavity 17 in the ring motor 13, the well fluid is further passed into the impeller 4 where it is accelerated, thereby giving it an increased dynamic pressure. When the well fluid leaves the impeller 4, it is passed into the diffuser 3 where parts of the dynamic pressure are converted to a static pressure. In this manner the well fluid is lifted internally from each pump step 7 to an overlying pump step 7 right up until it leaves the pump with sufficient pressure to enable it to be lifted to the surface.

Figure 3:
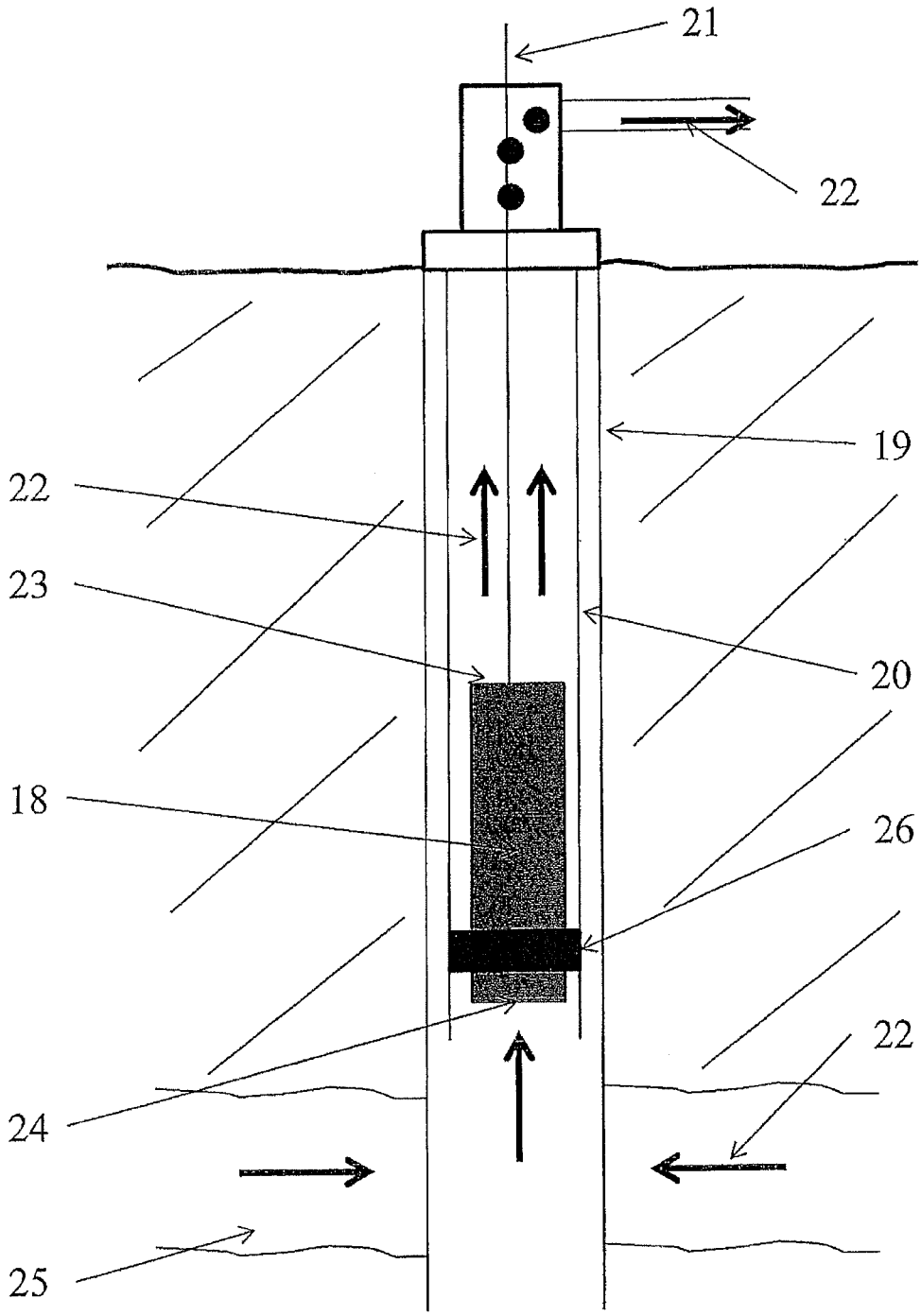
FIG. 3 is a principle drawing of a temporary installation of a pump.

FIG. 3 provides a schematic introduction to how the pump 18 will work when it is temporarily installed in a well 19. In the illustrated embodiment in FIG. 3 the pump 18 is temporarily installed in the well's 19 tubing 20 by means of a cable 21. Well fluids 22 (hydrocarbons and water) enter the well 19 from subsurface formations 25. The well fluids 22 rise up towards the pump's 18 inlet 24, pass through the pump steps 7 where they are supplied with pressure before leaving the pump's outlet 23 at the top with sufficient pressure to enable them to be lifted to the surface. In cases where the pump 18 is temporarily installed in a well 19, the pump 18 and the cable 21 will be pulled up and removed from the well 19 when the well fluid has sufficient pressure to flow by itself. In order to avoid the well fluids 22 circulating between the pump's inlet 24 and outlet 23, the pump is provided with a packer 26 which acts as a hydraulic barrier between the inlet 24 and the outlet 23.

Figure 4:
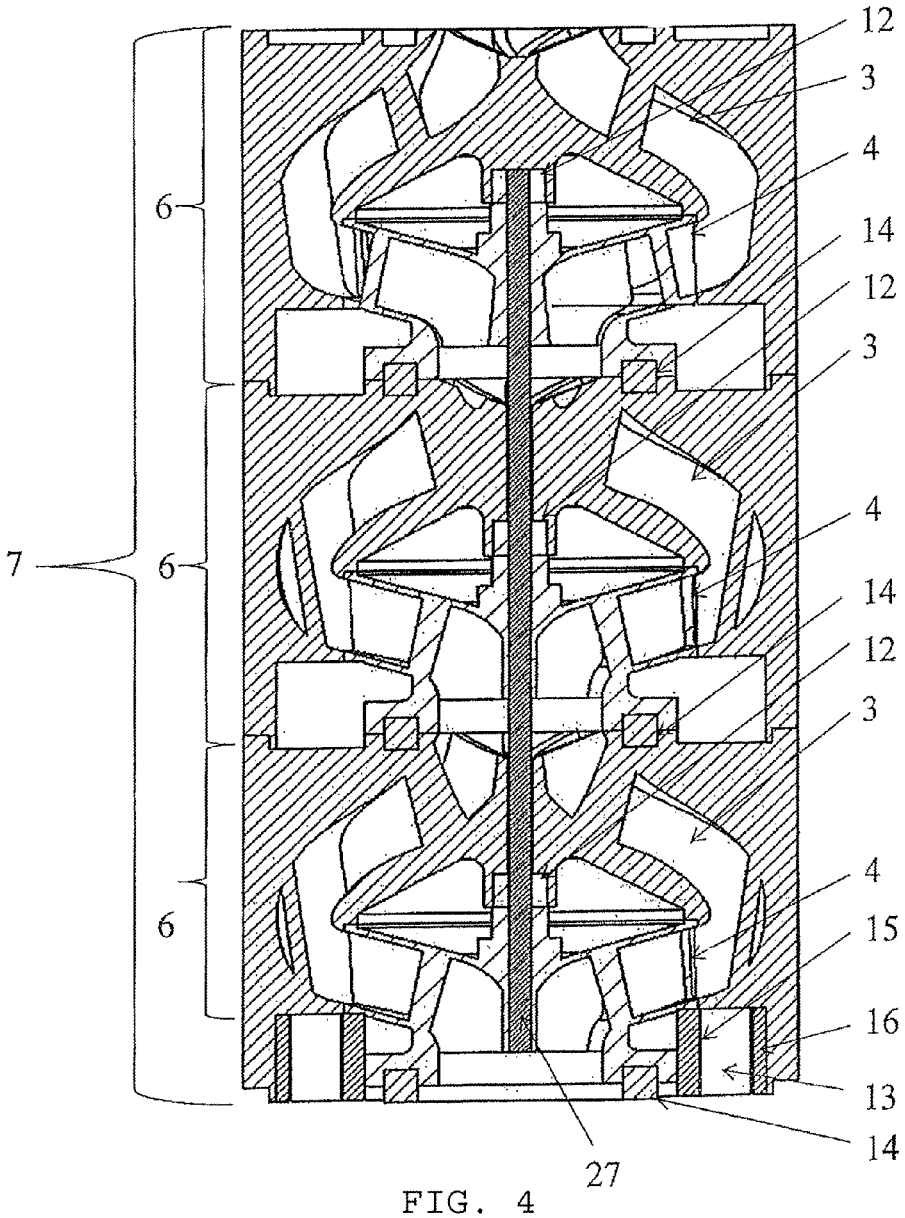
FIG. 4 is a sectional view of a pump step with three pump stages driven by a ring motor.

FIG. 4 illustrates an embodiment of a pump step 7 with three pump stages 6. The lowest pump stage 6 in FIG. 4 (the one located at the bottom of the pump step 7) is driven by a ring motor 13 consisting of a stator 16 and a rotor 15. The figure shows that in this embodiment all three impellers 4 are driven by a common shaft 27 which in turn is attached to the impeller 4 in the lowest pump stage 6 in the figure, and where this impeller 4 in turn is attached to the rotor 15 in the ring motor 13 which then drives all the pump stages 6 in this pump step 7. The figure further illustrates that in this embodiment each single pump stage 6 is provided with a radial bearing 12 and an axial bearing 14.

Figure 5:
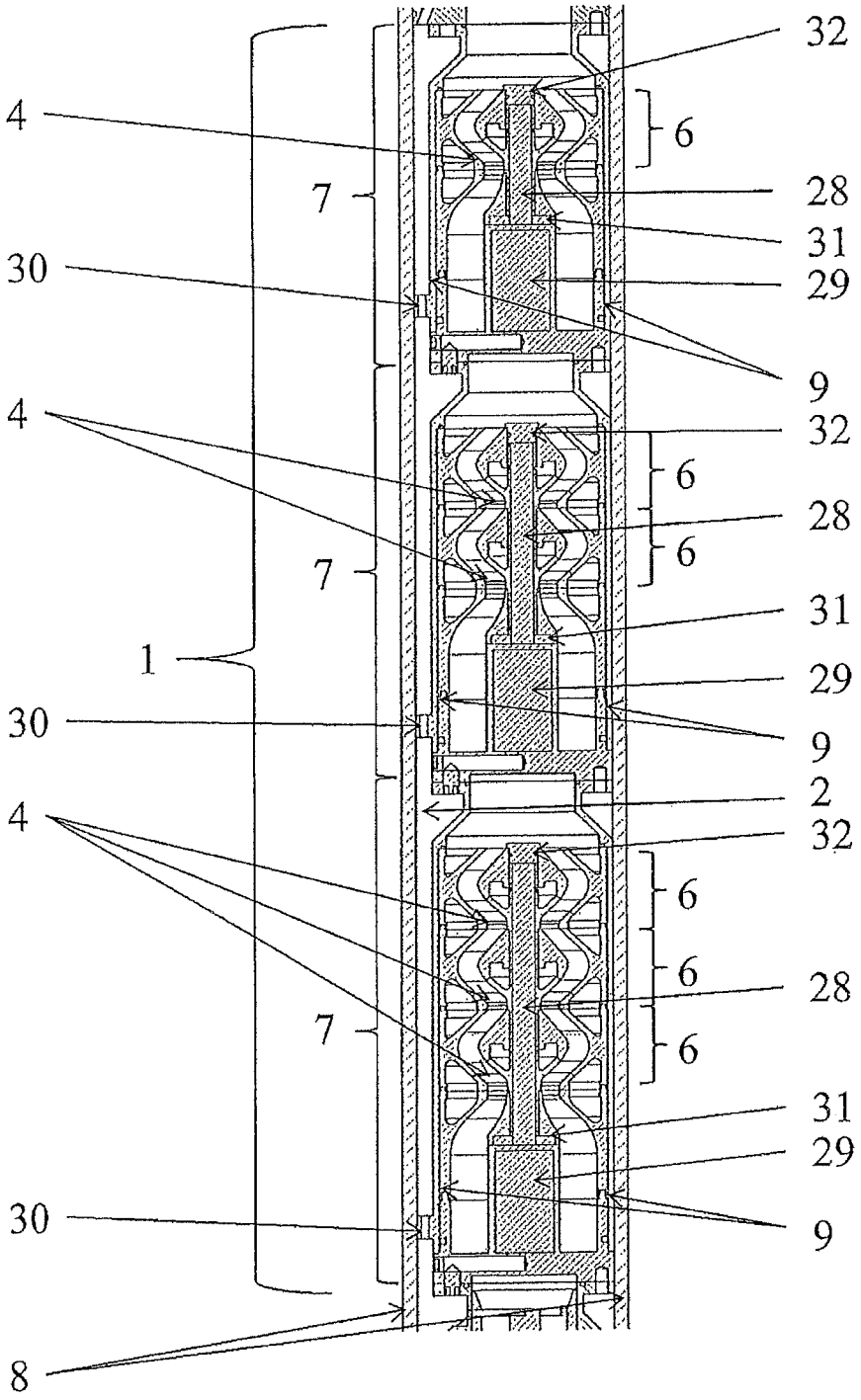
FIG. 5 is a sectional view of a section with three pump steps which have one, two and three pump stages respectively, where each pump step is driven by axial motors.

FIG. 5 illustrates a cut of an embodiment of a pump section 1 with three pump steps 7 which have one, two and three pump stages 6 respectively (counting from the top of the pump section 1 and from the top of FIG. 5). Each of these pump steps 7 is driven by axial motors 29. From each axial motor 29 there extends a shaft 28 which is attached to the rotor part inside the axial motors 29, and on these shafts 28 all the impellers 4 in the pump section 1 are attached in such a manner that they rotate when the axial motors 29 are in operation. FIG. 5 also shows distance pieces 30 with lead-through holes for cables. These distance pieces 30 lock the inner casings 9 asymmetrically in the outer casing 8. In this embodiment each pump stage 6 is also provided with a necessary number of axial bearings 31 and radial bearings 32 in order to absorb the dynamic forces generated when the pump steps 7 are in operation.

Figure 6:
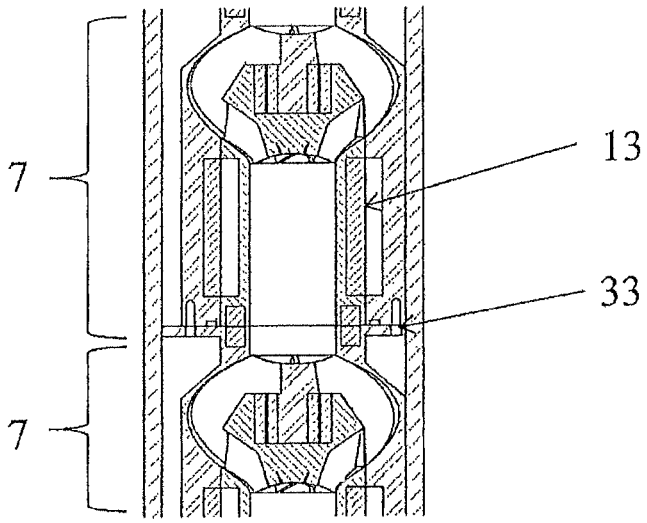
FIG. 6 is a sectional view of an embodiment for connecting two pump steps.

FIG. 6 illustrates a cut of an embodiment of a connection 33 of two pump steps 7, where the pump steps 7 in this embodiment are driven by ring motors 13. Each pump step 7 is an independent unit in relation to the surrounding pump steps 7, with the result that if one pump step 7 stops working during operation, the other pump steps 7 will still be able to lift the well fluid to the surface.

Figure 7:
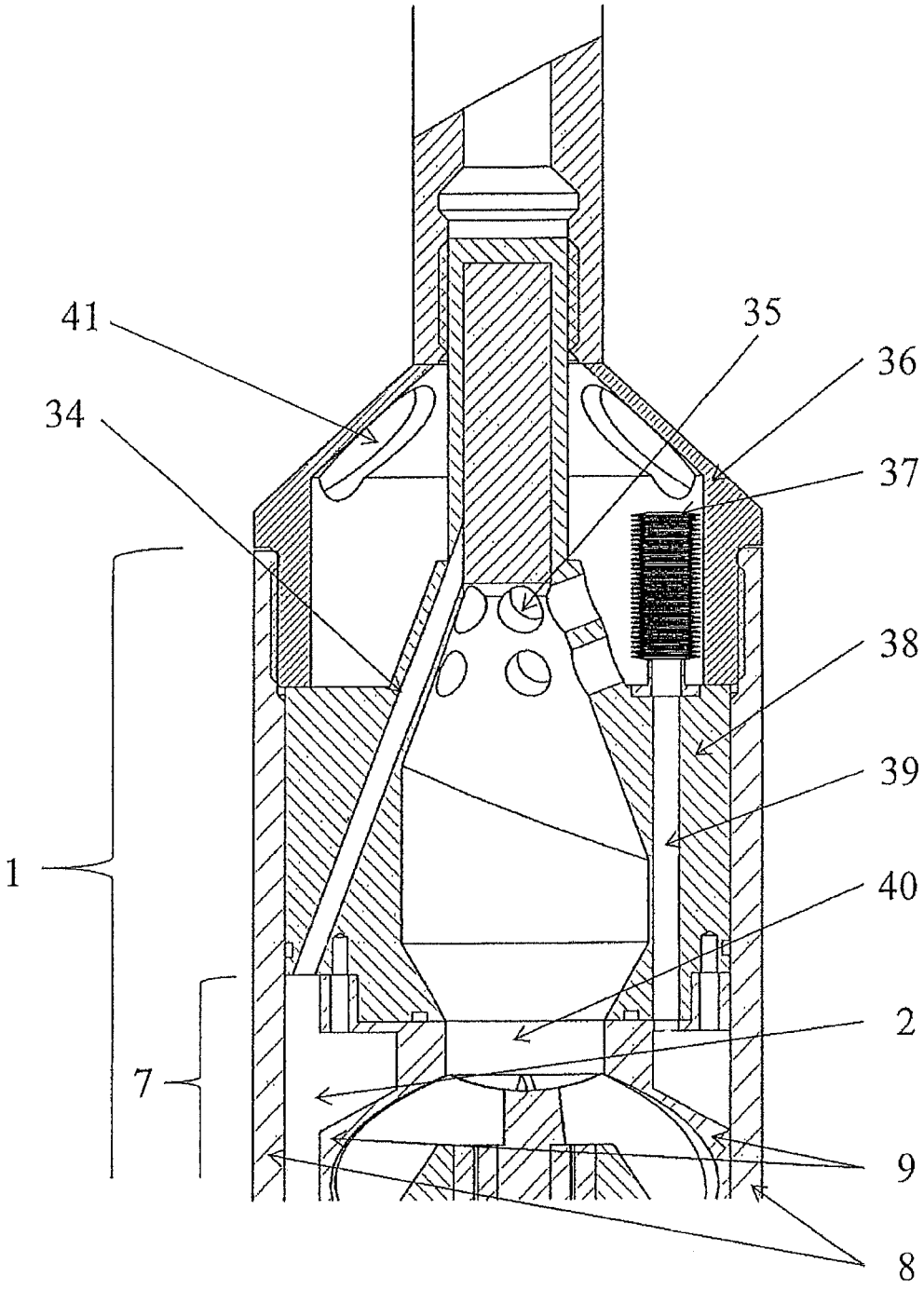
FIG. 7 is a sectional view through the top of a pump section in the pump when it is installed temporarily in a well.

FIG. 7 illustrates a cut through the top of a pump section 1 in an embodiment where the pump is installed temporarily in a well. FIG. 7 shows the top of a pump step 7 where the well fluid is discharged from the pump step 7 through the channel 40 in the top of the pump step 7. The well fluid then passes on through the cavity in the top piece 38 before being discharged through the holes 35 in the top piece 38 and then out through the holes 41 in the locking ring 36, ending internally in the well's tubing. In FIG. 7 an embodiment is also illustrated where a metal bellows 37 is mounted in the top piece 38, where this part of the top piece will be filled with well fluid, exposing the metal bellows 37 to the well fluid and thereby also to the well pressure. The metal bellows 37, which are filled with fluid, are compressed when well pressure increases and expand when well pressure falls, which means that the well pressure compensates the pressure inside the fluid-filled annular volume 2 via the channel 39 in the top piece 38. There is thus the same absolute pressure on the inside and the outside of both the inner casing 9 and the outer casing 8.

Figure 8:
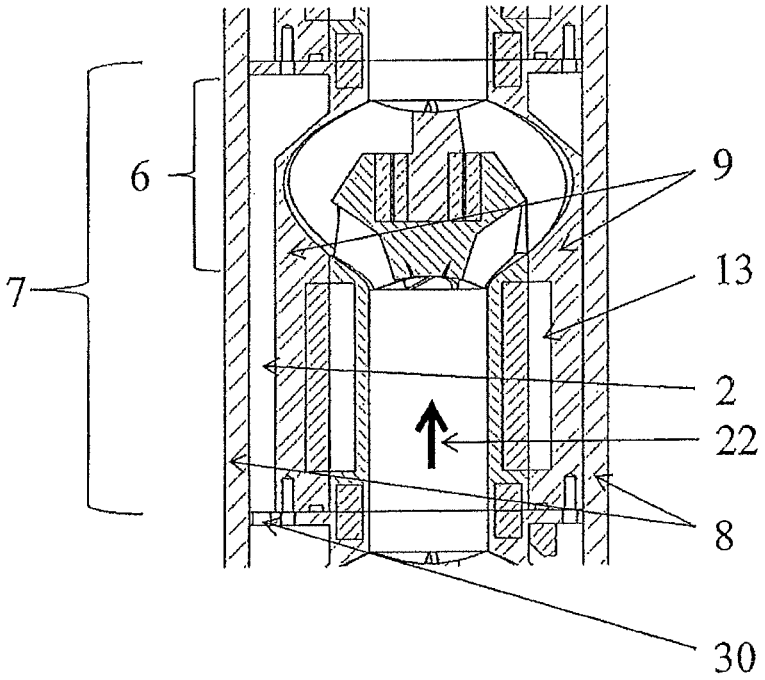
FIG. 8 is a sectional view through a cut of a pump section with a pump step which has one pump stage driven by a ring motor.

FIG. 8 is a sectional view through a cut of a pump section with a pump step 7 which has a pump stage 6 driven by a ring motor 13 where the well fluids 22 are flowing in the centre of the ring motor 13. The figure also shows the fluid-filled and pressure-compensated annular volume 2 which is enclosed by the outer casing 8 and bounded by the inner casing 9. In the bottom of the pump step 7 an embodiment is illustrated of the distance piece 30 with lead-through hole which ensures that the inner casing 9 is located asymmetrically relative to the outer casing 8.

Figure 9:
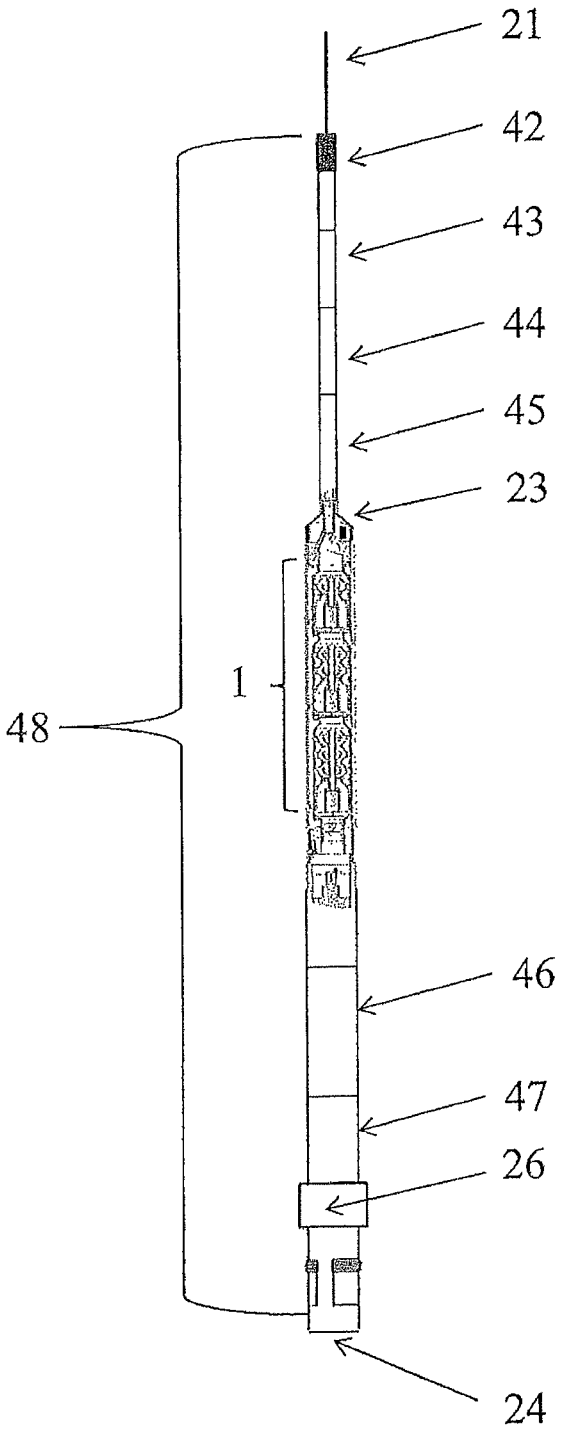
FIG. 9 illustrates a pump for temporary installation in a well, with a sectional view of the pump section.

FIG. 9 illustrates a pump mounted on a tool string 48. This tool string 48 is used for temporary installation of the pump in a well. By temporary installation it should be understood that the pump will only remain in the well for a limited period in order to start production therein. At the top of the tool string 48 in this embodiment a cable head 42 is illustrated which is used for attaching the tool string 48 to the cable 21 which goes all the way to the surface. Below the cable head 42 in the longitudinal direction a telemetry section is located, which is employed for transmitting data to the surface from various sensors in the tool string 48 and for receiving data from the surface for control of elements in the tool string 48. Under the telemetry section 43 there is a depth control unit 44, under which in turn is an electrical section 45. This is employed for converting the electric power from the surface from direct current to alternating current which is further transmitted down in the pump section 1 via cables inside the tool string 48 for operation of the motors in the pump steps 7. Below the section 1 is a transition 46 to the plug 47 which is provided with a packer 26. When the tool string 48 has reached the desired depth in the well, the packer 26 is expanded by means of the setting mechanism in the plug 47 with the result that the packer 26 contacts the inside of the tubing in the well. The packer 26 thereby shuts off the hydraulic communication between the inlet 24 for the well fluids and the outlet 23 for the well fluids.

Figure 10:
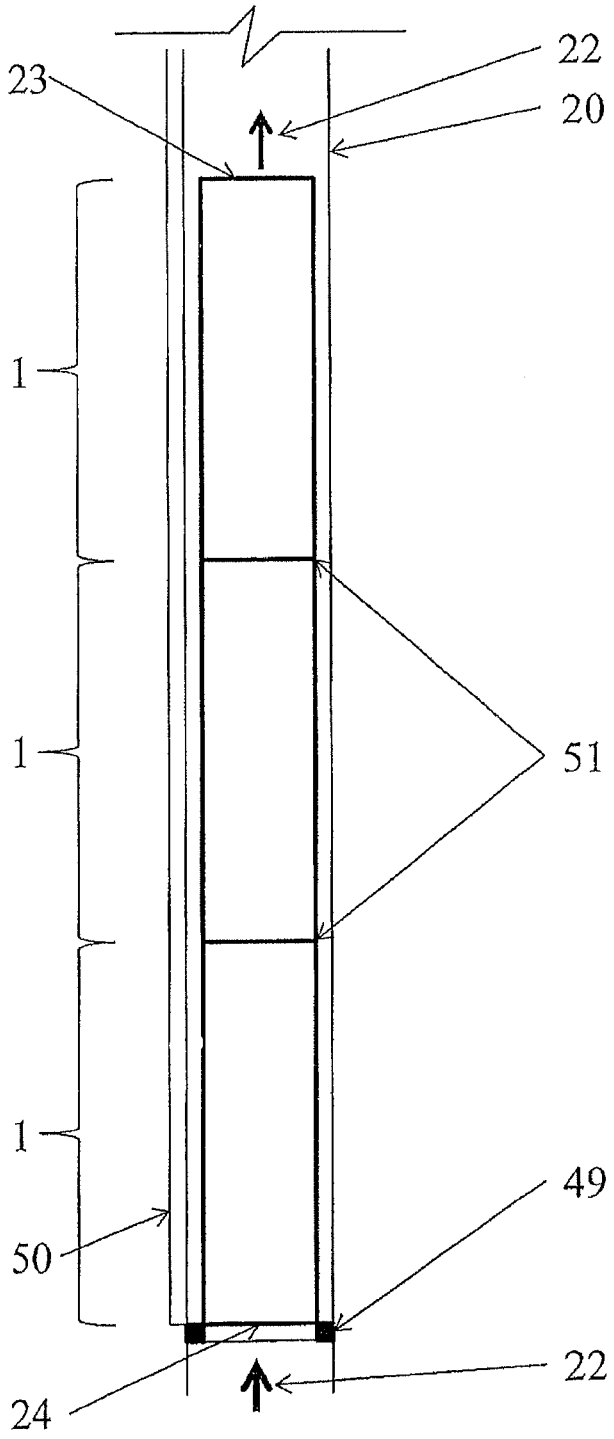
FIG. 10 is a schematic view of an embodiment of a permanent installation of three pump sections in a well.

FIG. 10 is a schematic illustration of an embodiment of a permanent installation of three pump sections 1 in the production tubing 20 in a well. Each pump section 1 can be run into the well by means of a cable or a pipe. The lowest pump section 1 is first run into the well and lands in a profile 49 which is installed in advance together with the tubing 20. The profile 49 is an integrated part of the tubing 20. This profile 49 is supplied with power and necessary cables for data transfer from the surface via the cable 50 which is also installed in advance in the well together with the tubing 20. In the transition 51 between the pump sections 1 there is a wet connector which is schematically illustrated in FIG. 11.

When all three pump sections 1 illustrated in this embodiment are in place in the tubing 20, the pump can be started. The well fluids 22 are then admitted to the pump through its inlet 24, and the well fluids 22 are supplied with the necessary pressure as they are pumped through the pump steps and the pump stages in the pump sections 1 before being discharged into the tubing through the pump's outlet 23 with sufficient pressure to enable them to flow to the surface.

Figure 11:
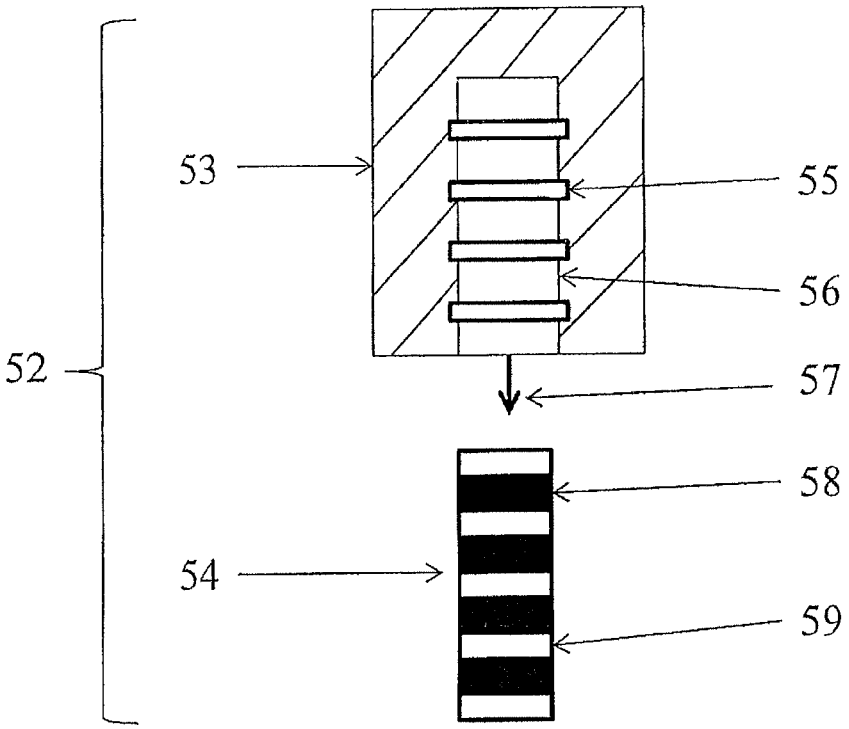
FIG. 11 is a principle drawing with a cut through a wet connector.

FIG. 11 illustrates a principle drawing of a wet connector 52. In this embodiment the wet connector 52 is located in such a manner that the well fluids will flow on the outside of the female part 53 when the pump is in operation, but internally in the outer casings. The male part 54 will be located as an integrated part in an underlying pump section and the female part 53 as an integrated part in an overlying pump section. During installation, the underlying pump section will first be installed into the well. When it is in position, the overlying pump section is run into the well and lands on the underlying pump section, whereupon the female part 53 will slide down the male part 54 in the direction of the arrow 57. When the pump sections are in position in the well, the female part 53 will enclose the male part 54 thereby providing electrical contact and communication between the two pump sections. The female part 53 is equipped with electrical connectors 55 which match the male part's 54 electrical connectors 58. The female part's electrical connectors 55 are separated from one another by electric insulators 56. The male part's 54 electrical connectors 58 are also separated from one another by electrical insulators 59.

Figure 12:
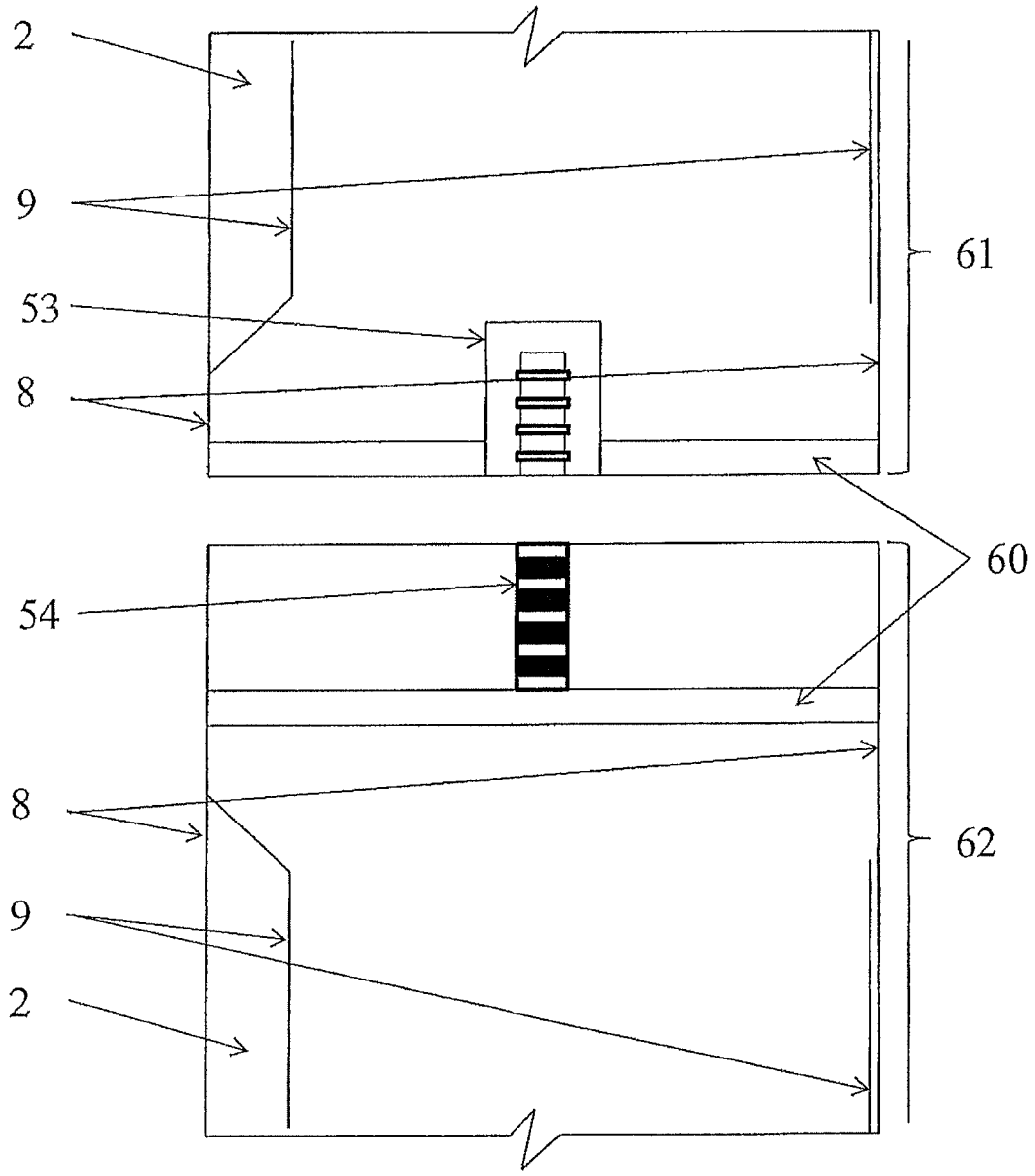
FIG. 12 is a principle drawing of a cut through a connection of two pump sections.

FIG. 12 illustrates a principle drawing of a section through a connection of an overlying pump section 61 and an underlying pump section 62. When the two pump sections 61, 62 in this embodiment are joined, the female part 53 of the wet connector will slide down the male part 54 in the wet connector, thereby providing electrical connection of the two pump sections 61, 62. Both the female part 53 and the male part 54 are each connected against its pump section 61, 62 by means of mounting brackets 60, which in turn are fixed to the outer casing 8 in the pump sections 61, 62. In FIG. 12 it is also shown how the female part 53 and the male part 54 in this embodiment are located relative to the asymmetrical, fluid-filled and pressure-compensated annular volume 2 and the inner casings 9.

The present disclosure has now been described by a non-limiting embodiment. A person skilled in the art will, however, understand that a number of variations and modifications of the pump may be implemented within the scope of the present disclosure, as defined in the attached patent claims.

The invention claimed is:

1. A pump section with a centre line in the axial longitudinal direction, wherein the pump section comprises:

at least two pump steps, the pump steps having a centre line and each pump step comprising a motor and one or more pump stages, wherein the pump section comprises an outer casing enclosing one or more inner casings, the outer casing forming a confined and sealed enclosure round the pump section and having a larger diameter than the inner casings, the inner casings forming a confined and sealed enclosure round the at least two pump steps, wherein the centre line of the pump section is displaced relative to the centre line of the pump steps, thereby forming an annulus between the outer casing and the inner casing, wherein the annulus is sealed to prevent fluids from penetrating into the annulus, and wherein the inner casings comprise at least one distance piece, on a radial outside surface of the inner casings, that displaces the centre line of the pump steps relative to the centre line of the pump section.

2. A pump comprising:

at least one pump section, wherein the pump section has a centre line and comprises at least two pump steps, the pump steps having a centre line and each pump step comprising a motor and one or more pump stages, wherein the pump section comprises an outer casing enclosing one or more inner casings, the outer casing forming a confined and sealed enclosure round the pump section and having a larger diameter than the inner casings, and the inner casings forming a confined and sealed enclosure round the two pump steps, wherein the centre line of the pump section is displaced relative to the centre line of the pump steps, thereby forming an annulus between the outer casing and the inner casing, wherein the annulus is sealed to prevent fluids from penetrating into the annulus, and wherein the inner casings comprise at least one distance piece, on a radial outside surface of the inner casings, that displaces the centre line of the pump steps relative to the centre line of the pump section.

3. The pump according to claim 2, wherein the annulus is fluid-filled and in pressure communication with a surrounding fluid.

4. The pump according to claim 2, wherein each pump stage comprises an impeller and a diffuser.

5. The pump according to claim 2, wherein the pump is configured to permit installation of the pump by cables or pipes.

6. The pump according to claim 2, wherein the distance pieces comprise lead-through holes for cables, wires, or lines.

7. The pump according to claim 2, wherein the pump steps are driven by either ring motors or axial motors.

8. The pump according to claim 7, wherein the motors are permanent magnet motors or electric induction motors.

9. The pump according to claim 2, wherein the pump stages in each pump step are connected to a common shaft.

10. The pump according to claim 2, wherein the pump sections are electrically connected by wet connectors.

11. The pump according to claim 2, wherein the motors in the pump steps are electrically connected, thereby enabling them to be operated independently of one another, with the same or a different number of revolutions per minute, and with the same or a different direction of rotation.

12. The pump according to claim 2, wherein axial bearings and radial bearings are employed to absorb the forces generated by rotation of the motors.

13. The pump according to claim 12, wherein the bearings are active magnetic bearings, passive magnetic bearings and/or mechanical bearings.

14. The pump according to claim 2, wherein fluid-tight couplings are provided between each pump step in the pump sections so that the inner casings are fluid-tight.

* * * * *